United States Patent [19]

Fester et al.

[11] Patent Number: 4,524,041

[45] Date of Patent: Jun. 18, 1985

[54] PROCESSES FOR PREPARING THERMOSTABLE FIBERS AND FILAMENTS

[75] Inventors: Walter Fester, Königstein; Bernd Huber, Kelheim, both of Fed. Rep. of Germany

[73] Assignee: Hoechst Aktiengesellschaft, Fed. Rep. of Germany

[21] Appl. No.: 473,050

[22] Filed: Mar. 7, 1983

[30] Foreign Application Priority Data

Mar. 18, 1982 [DE] Fed. Rep. of Germany ..... 3209795

[51] Int. Cl.[3] ..... D01F 6/18; D01F 6/00

[52] U.S. Cl. ..... 264/182; 8/115.6; 8/115.68; 428/253; 264/184; 264/206; 264/210.5

[58] Field of Search ..... 8/115.5, 115.6; 264/29.2, 182, 184, 78, 206; 428/253

[56] References Cited

U.S. PATENT DOCUMENTS

| | | | |
|---|---|---|---|
| 3,242,000 | 3/1966 | Lynch | 8/115.5 |
| 3,273,956 | 9/1966 | Fujita et al. | 8/115.5 |
| 3,281,261 | 10/1966 | Lynch | 264/29.2 |
| 3,406,145 | 10/1968 | Hennes | 8/115.5 |
| 3,468,841 | 9/1969 | Caubiere et al. | 264/182 |
| 3,681,004 | 8/1972 | Torrance | 264/182 |
| 3,733,386 | 5/1973 | Shimoda et al. | 264/182 |
| 3,917,776 | 11/1975 | Sato et al. | 423/447.5 |
| 4,267,233 | 5/1981 | Tanaka et al. | 428/253 |
| 4,378,226 | 3/1983 | Tomibe et al. | 8/115.5 |

FOREIGN PATENT DOCUMENTS

| | | | |
|---|---|---|---|
| 37-3920 | 6/1962 | Japan | 264/182 |
| 56-148965 | 11/1981 | Japan | 264/182 |
| 1397620 | 6/1975 | United Kingdom . | |
| 914666 | 3/1982 | U.S.S.R. | 264/182 |

*Primary Examiner*—Donald Czaja
*Assistant Examiner*—Hubert C. Lorin
*Attorney, Agent, or Firm*—Connolly and Hutz

[57] ABSTRACT

The invention relates to continuous processes for preparing dimethylformamide-insoluble acrylic filaments and fibers which incur a weight loss of at most 20, preferably 15% on being heated up to 400° C., by spinning appropriate polymer solutions, treating the filament bundles obtained before the first drying or heating stage in a continuous manner with an aqueous solution containing copper(I) ions, thermally fixing the copper content, and heating the bundles to 200° to 350° C.

10 Claims, No Drawings

PROCESSES FOR PREPARING THERMOSTABLE FIBERS AND FILAMENTS

The invention relates to continuous processes for preparing N,N-dimethylformamide-insoluble acrylic filaments and fibers which incur a weight loss of at most 20%, preferably 15%, on being heated up to 400° C.

Under these conditions conventional polyacrylonitrile filaments and fibers incur a weight loss of about 30 to 40%, and largely lose their textile properties.

Hitherto it was possible to obtain fibers having a similar, low, weight loss only by means of a separate pre-oxidation, of the type known for preparing carbon fibers. This usually very time-consuming and expensive pre-oxidation cannot be combined with the production process for the starting filaments so as to give one continuous process.

There have therefore been no shortages in attempts, in particular in recent years, to shorten the pre-oxidation time by the use of heavy metal salts as catalysts. For example, it has been proposed that polyacrylonitrile filaments or fibers be impregnated with a copper(II) chloride solution.

However, even under these conditions, which are described in Japanese Published Application No. 49-035,629, the pre-oxidation still takes 3 hours.

The treatment of acrylic fibers with copper(I) salts, to render them dyeable with acid dyestuffs, was only used in the early days of acrylic fiber processing, as the so-called cuprous ion dyeing method. This work is described in summary by, for example, Rath et al. in "Melliand Textilberichte", 38, (1957), pages 431 to 435 and 538 to 542. More recently Japanese Published Application No. 51-90,387 described aftertreating of moldings with copper(I) salts to catalyze the pre-oxidation when thermostabilizing these products.

The reaction of copper(I) salts with polymers which contain acrylonitrile components gives a cuprous ion complex with the nitrile groups of the polyacrylonitrile. However, reacting copper(I) salts with polyacrylonitrile after it has been shaped into structures is extremely involved and, due to the instability of copper(I) salts in aqueous solutions, in particular at elevated temperatures, cannot be carried out to give reproducible results. The treatment of polyacrylonitrile powders with solutions of copper(I) salts leads to products which are insoluble in the known solvents for polyacrylonitrile, or gel-like unspinnable materials form when preparing dopes. If, for example, copper(I) salts are added to a prepared spinning dope, the dope starts to gel and can no longer be spun in fault-free fashion while the extrusion of spinning compositions containing copper(I) salts into injection-molded articles may still not be prevented.

There was thus still the unsolved object of preparing in a simple, continuous manner, from organic polymers, filaments and fibers which have the same, or even better, properties as the filaments obtained by lengthy pre-oxidation. It has now been found, surprisingly, that it is possible to prepare dimethylformamide-insoluble acrylic fibers and filaments having increased thermostability if the polymers, which are usually spun into bundles or tows, are treated in a continuous manner during the fiber production process before the first drying stage or a first heat treatment above 100° C. with an aqueous solution containing copper(I) ions, the copper content in the bundles or tows is fixed by means of concurrent or subsequent heating at temperatures above 60, preferably above 100° C., and the bundles or tows are heated to temperatures of 200° to 350° C. during or after drying. In this process, the absorption of copper(I) ions takes place within seconds, and can therefore be integrated without difficulties into the process for producing acrylonitrile-containing filaments and fibers. It is quite immaterial whether the filaments were produced using a dry- or wet-spinning method. The absorption of copper(I) ions takes place of course particularly readily in the case of wet-spun filaments; but it is also possible to load copper(I) ions onto dry-spun but still solvent-containing filaments within the wash process or after-treatment process. According to the amount of copper(I) ions desired in the fiber the treatment can be carried out before, during, or after the bundles or tows have been washed. The copper(I) content in the filaments can of course also be affected by the length of the treatment time and the concentration in the bath liquid.

The absorption of copper(I) ions from a bath or from a spray section at room temperature is largely a reversible step, i.e. it is possible to remove the copper content by subsequent washes. For this reason it is necessary to ensure that the copper content is fixed in the fiber. This fixing can be effected by means of a heat treatment above about 60° C., preferably above 85° C., or by means of a drying step in which correspondingly high temperatures are usually exceeded. The temperature used is of course not the only important parameter in the fixing process, the other being the dwell time of the filaments or tows. While fixing at, for example, 65° C. requires prolonged dwell times, the same effect can be obtained at temperatures above 100° C. in a minute or, in certain circumstances, a few seconds. In contrast to the absorption of copper(I) ions from aqueous solutions at room temperature, the use of bath temperatures above about 60° C. leads to the copper(I) ions being simultaneously fixed in the polymer molecule. If, for example, the copper(I) bath is maintained at the boil, the absorption and fixation of the copper(I) ions takes place at the same time. However, this process has the disadvantage that the stability of aqueous solutions containing copper (I) ions generally markedly decreases with temperature, thereby usually markedly reducing the extent to which the absorption of copper ions can be controlled.

After such a heat treatment or fixing treatment the copper(I) content can no longer be washed out, presumably because under these conditions the copper(I) ions have been incorporated in the form of complexes in the polyacrylonitrile.

In a conventional procedure, the tow or the bundles are pulled through a bath containing copper(I) ions, substantially squeezed to remove excess bath liquid, and passed, for example, over hot godets having a surface temperature of, for example, 100° C. Thereafter if desired a further wash can be provided to remove from the filaments copper salts and the like adhering to the surface, and a customary spin finish can be applied to the filaments or tow in a subsequent bath before they are finally dried.

However, it is also possible to treat the tows directly before the first drying stage with a copper(I) ion solution and to fix the ions concurrently with the drying stage. In this case the surface of the filaments does not have complexed copper compounds which can be dissolved off through a first contact with water. Instead of using heated godets or rolls it is also possible to carry out the heat treatment to fix the copper content in a steam atmosphere, for example at temperatures above 95° C., or with the use of infrared radiators or by passing the fiber through a contact heat section.

In all cases the treatment medium is an aqueous solution of copper(I) salts. Such a solution can be prepared in various ways. The following possibilities are mentioned as examples:

The solution desired can be obtained by dissolving copper(I) salts, for example CuCl, in water, but because of the poor solubility of the salts it is advantageous to prepare the solutions in 20 to 50% strength sodium chloride solutions.

A copper(I) ion solution can also be generated directly, by reducing copper(II) solutions electrolytically or by heating copper(II) salt solutions in the presence of metallic copper, which is added in the form of a powder or can be generated by electrolysis. The solution can also be prepared by mixing a copper(II) salt solution with a reducing agent. The copper salt $CuSO_4 \times 5\ H_2O$ has proved particularly suitable in this method for use as the customary copper(II) salt.

Of the many possible reducing agents aldehyde sulfoxylates, and of these in particular the sodium salt of hydroxymethanesulfinic acid, have been found to be particularly suitable, since highly stable high copper(I) ion concentrations can be obtained by means of this system. The stability can be increased still further by means of suitable complexing agents. The low temperatures required of the aqueous solutions contribute significantly to the stability of the copper(I) solutions. In contrast to the old cuprous ion method, which was carried out at the boil, a temperature in the proximity of room temperature is virtually sufficient in almost all cases. Temperatures slightly above room temperature, i.e. temperatures of, for example, 25° to 30° C., may be used, since in this method the temperature constancy of the bath can be ensured by very simple technical means. If desired, the treatment can also be carried out at higher temperatures, for example 60° to 95°·C.

Since the stability of copper(I) solutions is only guaranteed for brief times, even at room temperature, the following procedure has been found to be particularly suitable:

A copper(II) salt solution in water and an aqueous solution which contains the reducing agent are separately metered into the bath, in the vicinity of the point where the tow enters, and are mixed in the bath. In this way it is possible to ensure that the tow is always treated with fresh copper(I) solution. The tow and the bath liquid are in parallel flow, excess bath liquid, which preferably is largely spent, is drawn off the trough in the vicinity of the point where the tow exits, and, for example, returned after having been replenished.

The concentration of the copper(I) ions can vary within wide limits, according to the fiber properties desired. If the copper(I) solution is prepared by reducing copper(II) compounds, the reducing agent must be used in at least the stoichiometric amount. The reduction is preferably carried out with a slight excess, in order to avoid the presence of copper(II) salts. Unlike copper(I) compounds copper(II) ions cannot be complexed by the polymer molecules, and they are thus washed out in subsequent washes and pollute the effluent. A pronounced excess of reducing agents does not in general yield further benefits. On the contrary, there is the danger of the copper(I) compound being reduced further, to give metallic copper, which can no longer be incorporated into the filaments or fibers. An apparent exception to this are the aldehyde sulfoxylates, where at room temperature even a relatively large excess does not increase the degree of copper deposition.

The process according to the invention can employ the industrially customary methods for producing polyacrylonitrile fibers and filaments. As already mentioned above, the wet-spinning method yields particular benefits, since, in general, copper(I) ions diffuse more readily into wet-spun filaments than into dry-spun filaments.

The copper(I) ion solution can be applied to the tows or filament bundles by various known methods, thus, for example, by passing the tows or bundles through a bath. However, it is also possible to apply the solution using spray sections or the like. It is advantageous to squeeze the tows or bundles very thoroughly before and after the treatment with the aqueous copper(I) ion solution. In this way it is ensured that the degree of carry-over of copper ions into other baths and the unnecessary dilution of the copper(I) ion treatment bath remain within tolerable limits. It is of course advantageous to take measures which ensure efficient and uniform penetration of a tow or bundle in the treatment liquor. For example, tows should be passed through the treatment bath in a state sufficiently wide to ensure that depletion of copper ion concentration or retarded penetration of the treatment bath into the interior of the tow can ideally be neglected.

As already stated above, it is necessary to fix the copper(I) ions in the filament or fiber material by means of a thermal treatment. Only after the fiber has been heated to temperatures above 60° C., preferably above about 100° C., does the desired complex formation take place within a brief time, and the copper compounds can no longer be removed from the treated fiber material by means of a wash. A wash subsequent to the heat treatment of course washes of the quantity of copper compounds which was present at the surface of the filament material and could not be fixed.

The acrylonitrile-containing polymers used are understood as meaning those polymers of which more than 50%, preferably more than 85%, consists of acrylonitrile units. Particularly good results were obtained with polyacrylonitriles which are composed of at least 98% of acrylonitrile units. Examples of suitable further copolymer components are acrylic acid, methacrylic acid and their esters and amides, vinyl acetate, vinyl chloride, vinylidene chloride, vinylidene cyanide and other unsaturated compounds which can be copolymerized with acrylonitrile.

To ensure the desired good thermostability of the filaments or fibers produced a further heat treatment, at 200° to 350° C., preferably between 250° and 330° C., should be carried out after the drying stage or, if desired, even concurrently with the drying stage. In this heat treatment it is necessary to keep the filaments under tension or, preferably, even subject them to a small additional stretch. The filaments can be heated up to these temperatures by known, conventional methods, for example by repeatedly passing them over heated godets, by using infrared radiators, or by passing them through a contact heat section.

This high-temperature treatment under tension will have in general discolored the tows or fiber bundles treated, giving them dark brown to black colors. The thermal stability of the filaments obtained was investigated with the aid of thermogravimetric analysis. The measuring instrument used was a Thermoanalyzer 2 from Messrs. Mettler Instrumente AG, Greifensee, Zurich. The samples were heated to 400° C. at a rate of 10° C./min and with an air flow rate of 5 l/h, and then measured for weight loss. The filaments thus produced in a continuous manner incur a weight loss of only at most 20%, preferably less than 15%, when heated to 400° C. in such a way. They can be converted in a few minutes to pre-oxidized fibers or filament bundles which can then be subjected to a carbonization process above 700° C.

Owing to their good thermal stability, such filaments and fibers are also especially suitable for industrial uses, for example as a filter material for hot-gas filtrations, for manufacturing protective clothing and the like, and as reinforcing fibers or filaments for inorganic and organic materials, for example as a replacement for asbestos in, for example, friction linings or the like. It is also possible to render the products obtained virtually incombustible, by means of a further heat treatment in a relaxed state. The filaments are in general crimped by this heat treatment.

An important parameter in the heat treatment after drying, at temperatures of 200° to 350° C., is of course also the dwell time of the fiber material at these temperatures. In general, dwell times of a few seconds up to a few minutes are required to bring about the effect desired. In every case the heat treatment is so short that it can be integrated into a continuous filament or fiber production process.

Should it not be necessary to remove copper compounds adhering to the surface of the filaments or tows, it is possible to combine the copper-fixing process with the drying stage and the subsequent heat treatment.

The examples which follow are intended to illustrate the invention in more detail. Unless otherwise indicated parts are parts by weight and percentages are percentages by weight.

EXAMPLE 1

A 17% strength solution of polyacrylonitrile in dimethylformamide was spun in a known manner using the wet-spinning method. The polyacrylonitrile used consisted to 99.5% of acrylonitrile and to 0.5% of methyl acrylate, and had a relative viscosity of 2.9. The relative viscosity was measured on solutions which contained 0.5 g of polymer in 100 ml of N,N-dimethylformamide, and the measurement was carried out at 25° C. The temperature of the spinning dope was 90° C. A 300-hole jet was used which had a hole diameter of 80 μm.

This dope was spun into a spin bath of 50% of N,N-dimethylformamide (DMF) and 50% of water, at 50° C., and the filaments were taken from the coagulation bath at a speed of 7 m/min, then subjected to a wet stretch at 60° C. in a ratio of 1:2.31 in a bath which consisted to 60% of dimethylformamide and to 40% of water, and then washed with water at 30° C. until solvent-free. After the washing step the fiber band was squeezed to remove the bulk of the water, and passed through a trough which contained an aqueous solution of 100 g of $CuSO_4 \times 5\ H_2O$ per liter and 20 g, per liter, of the sodium salt of hydroxymethanesulfinic acid. This treatment bath also contained the necessary spin finish. Dwell time in this bath: about 1.5 seconds. The treatment solution was replenished by continually metering in an aqueous solution of 200 g/l $CuSO_4 \times 5\ H_2O$ and an aqueous solution of 40 g/l the sodium salt of hydroxymethanesulfinic acid ($CH_2SO_2\ Na \times 2\ H_2O$). The two solutions were mixed shortly before entry into the treatment trough.

After the fiber band had passed through the trough, it was squeezed again, then dried on two heated godets at 130° C. (contact time: 7 seconds), then subjected to a stretch of 1:1.85 on two heated godets at 170° C. (contact time: 14 seconds), subjected to a stretch of 1:1.61 on a further godet at 250° C. (contact time: 9 seconds), and then passed over a cold take-up element, to be wound up. The brownish black, discolored filaments obtained had a tensile strength of 25 cN/dtex, and elongation at break of 7.8%, and an initial modulus of 1,000 cN/tex, while the filament titer was 3.0 dtex. Thermal stability of these fibers was measured with the aid of the Thermoanalyzer 2 from Messrs. Mettler. In this test, the filaments prepared in this example incurred a weight loss of 12% when heated up to a temperature of 400° C. A fiber which had been prepared in the same way but which had not been treated with a copper(I) salt solution incurred a weight loss of 33% in this test method.

Heating the filaments or the fibers obtained at 300° C. in the relaxed state for 2 hours gave an incombustible fiber which had pronounced crimp.

EXAMPLE 2

A polymer solution as described in Example 1 was spun through a 600-hole jet having a hole diameter of 60 μm into a coagulation bath which consisted to 61% of DMF and to 39% of water. The temperature of the coagulation bath was 50° C. The freshly spun filaments were taken out of the coagulation bath at a speed of 6 m/min, subjected to a wet stretch at 98° C. of 1:4.86 in a bath which consisted to 62% of DMF and to 38% of water, and then washed with water at 80° C. until solvent-free. After the washing step the fiber band was squeezed to remove the bulk of the water, and passed through a trough which contained an aqueous solution of 75 g/l $CuSO_4 \times 5\ H_2O$ and 50 g/l of the sodium salt of hydroxymethanesulfinic acid (formula: $CH_2SO_2$-$Na \times 2\ H_2O$), and a customary spin finish. The solution was replenished by continually metering in an aqueous solution of 150 g/l $CuSO_4 \times 5\ H_2O$ together with an aqueous solution of 100 g/l of the sodium salt of hydroxymethanesulfinic acid. The two solutions were mixed shortly before entry into the treatment trough. The copper sulfate solution required for replenishing the bath also contained the spin finish.

After the fiber band had passed through the trough, it was squeezed again, then dried on two heated godets at 190° C. (contact time: 7 seconds), and then subjected to a stretch of 1:1.54 on two heated godets at 310° C. The tow was then heated up on two further godets having a surface temperature of 310° and 330° C. respectively and then passed with a further stretch, of 1:1.06, over a cold take-up element, to be wound up. The pure contact times of the treated tow at 310° C. were 50 seconds and 15.7 seconds at 330° C. The dark, discolored monofilaments of the treated tow incurred a weight loss of 7% when heated up to 400° C. The further, textile data were Titer: 1.5 dtex,
Tensile strength: 23 cN/tex,
Initial modulus: 1,160 cN/tex, and
Elongation at break: 7%.

All initial-modulus data are relative to a strain value of 100%.

EXAMPLE 3

The spin of Example 2 was repeated, except that the tow was treated with the copper solution, dried at 190° (contact time: 11 seconds), washed again, at 80° C., and spin-finished, and then subjected to a second drying stage at 190° C. (contact time: 11 seconds). The tow was then passed over 4 godets which had been heated to a surface temperature of 310°, 310°, 310° and 330° C. respectively. The contact time of the tow was 61 seconds at 310° C. and 18 seconds at 330° C. During the high-temperature treatment, the fibers were subjected to a stretch of 1:1.25. The filament material obtained was subjected to thermogravimetric analysis, and incurred a weight loss of less than 10% when heated up to 400° C. The measured textile data were Titer: 3.3 dtex,
Tensile strength: 30 cN/tex,
Elongation at break: 11%, and
Initial modulus: 811 cN/tex.

After a markedly shortened pre-oxidation as used for carbon fiber production, it was possible to carbonize the fibers or filament bundles obtained at temperatures above 700° C. The pre-oxidation time for these tows was less than 7 minutes, and hence only a small fraction of the time otherwise necessary.

EXAMPLE 4

Tows were prepared as in Example 3, and these samples were then heated in the relaxed state at 250° C. in a drying cabinet for 120 minutes. Highly crimped, non-combustible fibers were obtained. After this treatment the fibers had the following textile values:

Titer: 3.5 dtex,
Tensile strength: 30 cN/tex,
Elongation at break: 13%, and
Initial modulus: 800 cN/tex.

What is claimed is:

1. A process for preparing N,N-dimethylformamide-insoluble acrylic fibers and filaments having increased thermostability, comprising the steps of:

obtaining filament bundles or tows by means of wet- or dry-spinning of a solution of polymer which contains more than 50% by weight of acrylonitrile units, continuously treating the filament bundles or tows with an aqueous solution containing copper (I) ions during the fiber production process, while fresh from the wet-spinning process or while still containing solvent from the dry-spinning process, and before the first drying stage or a first heat treatment above 100° C. so that absorption of copper (I) ions by the filament bundles or tows takes place within seconds, fixing the copper content in the thus-treated bundle or tow, concurrent or subsequent to the treatment, by means of heating to a temperature above about 60° C., and heating the thus fixed copper containing filament bundles or tows to a temperature of 200° to 350° C. during or after the drying stage.

2. The process as claimed in claim 1, wherein the solution containing copper(I) ions is at about room temperature.

3. The process as claimed in claim 1 or 2, wherein the heat treatment during or after the drying stage takes place at 250° to 330° C.

4. The process as claimed in claim 1, wherein fixing the copper content and drying, drying and the subsequent heat treatment or all three heat treatments are carried out as a common process stage.

5. The process as claimed in claim 1, wherein the copper(I) ion concentration of the treatment solution is 0.1 to 50 g/l.

6. The process as claimed in claim 1, wherein the filament bundles or tows are subjected to a continuous treatment with a solution containing copper(I) ions, substantial wiping and/or squeezing to remove excess solution, and then to heat treatment above 60, which is followed by further wash processes, spin-finishing, and drying with subsequent thermal treatment.

7. The process as claimed in claim 1, wherein the solution containing copper(I) ions is continually generated and replenished by mixing a solution containing copper(II) ions with an aqueous solution containing a reducing agent which must be added in an at least stoichiometric ratio.

8. The process as claimed in claim 7, wherein a solution of copper(II) sulfate in water is used as the solution containing copper(II) ions and a solution of an aldehyde sulfoxylate in water is used as the solution containing reducing agent.

9. The process as claimed in claim 1, wherein said fixing step is carried out at a temperature above 100° C.

10. The process as claimed in claim 1, wherein the fibers or filaments produced by the process are brown or black in color.

* * * * *